US008124576B2

(12) United States Patent
Courchay

(10) Patent No.: US 8,124,576 B2
(45) Date of Patent: Feb. 28, 2012

(54) DETERGENT COMPOSITION COMPRISING A 2-PHENYL ISOMER ALKYL BENZENE SULFONATE AND AN AMINO ALCOHOL

(75) Inventor: Florence Catherine Courchay, Wemmel (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/873,354

(22) Filed: Sep. 1, 2010

(65) Prior Publication Data

US 2011/0065626 A1 Mar. 17, 2011

(30) Foreign Application Priority Data

Sep. 14, 2009 (EP) ..... 09170174

(51) Int. Cl.
*C11D 1/24* (2006.01)
*C11D 3/30* (2006.01)

(52) U.S. Cl. ..... 510/357; 510/276; 510/303; 510/304; 510/338; 510/342; 510/407; 510/414; 510/426; 510/432; 510/499; 510/525

(58) Field of Classification Search ..... 510/276, 510/303, 304, 338, 342, 357, 407, 414, 426, 510/432, 499, 525
See application file for complete search history.

(56) References Cited

U.S. PATENT DOCUMENTS

| | | | | |
|---|---|---|---|---|
| 2,220,099 | A | 11/1940 | Heidelberg et al. | |
| 2,477,383 | A | 7/1949 | Lewis | |
| 3,664,961 | A | 5/1972 | Norris | |
| 3,835,163 | A | 9/1974 | Rapko | |
| 3,923,679 | A | 12/1975 | Rapko | |
| 3,949,678 | A | 4/1976 | Theurer | |
| 4,102,903 | A | 7/1978 | Crutchfield et al. | |
| 4,105,827 | A | 8/1978 | Brichard et al. | |
| 4,120,874 | A | 10/1978 | Crutchfield et al. | |
| 4,158,635 | A | 6/1979 | Crutchfield et al. | |
| 4,222,905 | A | 9/1980 | Cockrell, Jr. | |
| 4,239,659 | A | 12/1980 | Murphy | |
| 4,246,612 | A | 1/1981 | Berry et al. | |
| 4,681,592 | A | 7/1987 | Hardy et al. | |
| 4,810,410 | A | 3/1989 | Diakun et al. | |
| 4,966,723 | A | 10/1990 | Hodge et al. | |
| 5,075,042 | A * | 12/1991 | Allison et al. | 510/429 |
| 5,114,611 | A | 5/1992 | Van Kralingen et al. | |
| 5,227,084 | A | 7/1993 | Martens et al. | |
| 5,580,456 | A * | 12/1996 | Bowlsbey | 210/493.2 |
| 5,945,394 | A * | 8/1999 | Sajic et al. | 510/428 |
| 6,083,897 | A * | 7/2000 | Lewis et al. | 510/351 |
| 6,506,261 | B1 * | 1/2003 | Man | 134/39 |
| 6,689,732 | B1 | 2/2004 | Guedira et al. | |
| 6,747,000 | B2 | 6/2004 | Pearce et al. | |
| 6,849,588 | B2 * | 2/2005 | Elsik et al. | 510/351 |
| 6,995,127 | B1 | 2/2006 | Smith et al. | |
| 7,008,914 | B2 | 3/2006 | Smith et al. | |
| 7,179,780 | B2 * | 2/2007 | Forth et al. | 510/393 |
| 7,329,441 | B2 | 2/2008 | Catlin et al. | |
| 7,595,290 | B2 | 9/2009 | Pounds et al. | |
| 7,677,015 | B2 | 3/2010 | Kroese et al. | |
| 7,786,027 | B2 | 8/2010 | Aouad et al. | |
| 2002/0137652 | A1 | 9/2002 | Gressel et al. | |
| 2003/0096726 | A1 * | 5/2003 | Smith et al. | 510/424 |
| 2004/0072717 | A1 * | 4/2004 | Cordellina et al. | 510/481 |
| 2004/0186035 | A1 | 9/2004 | Johnston et al. | |
| 2005/0065053 | A1 * | 3/2005 | De Buzzaccarini et al. | 510/295 |
| 2006/0030513 | A1 * | 2/2006 | Binder et al. | 510/515 |
| 2006/0263324 | A1 * | 11/2006 | Nguyen-Kim et al. | 424/70.17 |
| 2006/0270582 | A1 | 11/2006 | Boeckh et al. | |
| 2009/0176935 | A1 | 7/2009 | Boeckh et al. | |
| 2009/0298735 | A1 | 12/2009 | Boeckh et al. | |
| 2010/0183533 | A1 | 7/2010 | Giles et al. | |
| 2010/0191012 | A1 | 7/2010 | Giles et al. | |
| 2010/0197961 | A1 | 8/2010 | Giles et al. | |
| 2010/0305020 | A1 | 12/2010 | Jennewein | |

FOREIGN PATENT DOCUMENTS

| | | | |
|---|---|---|---|
| EP | 0482807 | A | 4/1992 |
| WO | WO 91/09932 | | 7/1991 |
| WO | WO 98/13467 | A1 | 4/1998 |
| WO | WO 99/02636 | A1 | 1/1999 |
| WO | WO 2006/130442 | | 12/2006 |

OTHER PUBLICATIONS

U.S. Appl. No. 12/873,401, filed Sep. 1, 2010, Labeque, et al.
U.S. Appl. No. 12/873,366, filed Sep. 1, 2010, Labeque.

* cited by examiner

*Primary Examiner* — Charles Boyer
(74) *Attorney, Agent, or Firm* — Julie A. McConihay; Leonard W. Lewis; Steven W. Miller

(57) ABSTRACT

The present invention relates to a liquid detergent comprising less than 40% total water or non-amino functional solvent, alkyl benzene sulphonate surfactant comprising greater than 20% of the 2 phenyl isomer and a gel breaker selected from the group consisting of amino alcohol compounds having a molecular weight above 61 g/mol, wherein the composition has a ratio of total surfactant to total solvent of greater than 1:1.

4 Claims, No Drawings

DETERGENT COMPOSITION COMPRISING A 2-PHENYL ISOMER ALKYL BENZENE SULFONATE AND AN AMINO ALCOHOL

FIELD OF THE INVENTION

The present invention relates to the field of cold storage stability of liquid detergent compositions.

BACKGROUND TO THE INVENTION

Detergent compositions comprise surfactants for cleaning soils from fabrics and other surfaces. A variety of surfactants exist. However a particularly preferred anionic surfactant is linear alkyl benzene sulphonate (LAS). LAS is a preferred surfactant since it provides superior cleaning and detergency power.

Linear alkylbenzene is typically manufactured on an industrial scale using one of three commercial processes which differ from one another primarily by virtue of the catalyst system employed. One process employs an aluminum trichloride catalyst, another process uses a hydrogen fluoride catalyst, while the third process uses solid alkylation catalyst, known as DETAL™. The three processes result in linear alkylbenzene products with different phenyl isomer distributions. The process for making LAS using the DETAL™ catalyst (UOP, LLC, Des Plaines, Ill.) as taught by Huntsman in U.S. Pat. No. 6,849,588 or US 2003/0096726A1, results in LAS products with a high percentage of the 2-phenyl isomer.

A typical phenyl isomer distribution for products of the hydrogen fluoride process is about 16% to 18% 2-phenyl isomer. By contrast the typical 2-phenyl isomer content of LAS made using the DETAL™ catalyst is higher, generally greater than 20%. This LAS species is often referred to as "high 2-phenyl" linear alkylbenzene, whereas the product of the hydrogen fluoride process, which is relatively low in 2-phenyl isomer content, is often referred to as "low 2-phenyl" linear alkylbenzene.

The benefits of using DETAL™ prepared LAS include the safety of the production process and improved detergency performance of the LAS.

The Applicant has found however that when formulating a detergent composition with the DETAL™ LAS, the composition freezes at a higher temperature as compared to when formulating with LAS produced using the HF catalyst. In some instances the composition has in fact frozen at temperatures as high as 10° C. The freezing of the composition is particularly noticeable when the composition is transparent and the frozen composition turns opaque. Moreover this phenomenon also leads to dissolution and performance issues, as the product cools and becomes more viscous. This phenomenon is more prevalent when the content of the 2 phenyl isomer of LAS is increased since the Krafft temperature of the surfactant system increases with increasing 2-phenyl isomer content.

The Applicant has therefore set out to find a solution to this problem of early freezing of the composition.

SUMMARY OF THE INVENTION

According to the present invention there is provided a liquid detergent comprising less than 40% total water or non-amino functional solvent, alkyl benzene sulphonate surfactant comprising greater than 20% of the 2 phenyl isomer and a gel breaker selected from the group consisting of amino alcohol compounds having a molecular weight above 61 g/mol, wherein the composition has a ratio of total surfactant to total solvent of greater than 1:1.

DETAILED DESCRIPTION OF THE INVENTION

The compositions of the present invention are liquid. The term 'liquid' is meant to include liquid, paste, waxy or gel compositions. The compositions may be newtonian or non-newtonian. The liquid composition may comprise a solid. Solids may include powder or agglomerates, such as microcapsules, beads, noodles or one or more pearlised balls or mixtures thereof. Such a solid element may provide a technical benefit, through the wash or as a pre-treat, delayed or sequential release component. Alternatively it may provide an aesthetic effect. The composition may also be packaged in a water-soluble material, forming a unitized dose of the composition. In such an embodiment, the water soluble material is preferably a film of Poly vinyl alcohol. MonoSol provide a variety of suitable films, including and preferably M8630. The unitized dose may be made using known processes including vertical form filing, but more preferably horizontal form filing. In such latter embodiments, water content should be kept to a minimum. Preferably said composition comprise less than 20% total water, more preferably less than 15% total water and most preferably less than 12% total water.

The present composition may be a microemulsion, but is preferably isotropic. Where the composition is a microemulsion, the oil phase, is preferably limited to less than 8%, more preferably less than 6% and most preferably less than 5% of the total composition. The composition may be opaque, but is preferably translucent. The composition of the present invention preferably has a freezing temperature below 4° C., more preferably below 2° C., and most preferably below 0° C.

High 2-Phenyl Alkyl Benzene Sulphonate

The present invention requires the presence of high 2 phenyl alkyl benzene sulphonate. By the term "2-phenyl alkyl benzenes", it is meant means a benzene ring having at least one alkyl group attached to it, wherein the alkyl group comprises any number of carbon atoms between 7 and 16 (including every integral number there between) linked to one another so as to form a substantially linear chain and wherein the benzene ring is attached the alkyl group at a carbon atom that is adjacent to the terminal carbon of the substantially linear chain. Thus, the carbon atom that is attached to the benzene ring has a methyl group and another alkyl group attached to it in a 2-phenyl alkylbenzene.

By the term "2-phenyl alkylbenzene sulphonate" it is meant 2-phenyl alkylbenzenes as defined above which further comprise a sulfonate group attached to the benzene ring of a 2-phenyl alkylbenzene as described above, regardless of the position of the sulfonate group on the ring with respect to the location of the alkyl group; however, it is most common and preferred that the sulfonate group is attached to the benzene ring in the para-position with respect to the alkyl group.

"2-phenyl linear alkylbenzene sulphonate" means a mixture of linear alkylbenzenes which comprises a benzene ring appended to any carbon atom of a substantially linear alkyl chain in the detergent range and a high 2 phenyl isomer content.

"Linear AlkylBenzene sulfonate or LAS" means which linear alkylbenzenes that has been sulfonated to include an acidic sulfonate group appended to the benzene rings (thus forming a parent acid), and subsequently rendered to a form more soluble to aqueous solution than the parent acid by neutralization using any of alkali metal hydroxides, alkaline earth hydroxides, ammonium hydroxides, alkylammonium hydroxides, alkanolamine or any chemical agent known by those skilled in the art to react with linear alkylbenzene sulfonic acids to form water-soluble linear alkylbenzene sulfonates.

The composition of the present invention comprises alkyl benzene sulphonate surfactant comprising greater than 20% of the 2 phenyl isomer, more preferably greater than 24% and most preferably greater than 30% of the 2 phenyl isomer. The LAS of the present invention is preferably derived from the DETAL™ process, developed by UOP, LLC, Des Plaines, Ill.

The compositions of the present invention preferably comprise greater than 8%, more preferably greater than 10%, most preferably greater than 12% high 2 phenyl isomer LAS by weight of the composition. In an alternate embodiment the composition may comprise mixtures of high 2 phenyl isomer LAS and other surfactants, particularly other anionic surfactants including low 2 phenyl content LAS. Preferably the composition comprises a mixture of high and low 2 phenyl content LAS. In this embodiment it is preferred that the high 2 phenyl content LAS accounts for at least 35%, more preferably at least 40% more preferably at least 45% of the total LAS in the composition.

Preferred high 2-phenyl LAS include the water-soluble salts, preferably the alkali metal, alkanolamine and ammonium salts, of the LAS. Preferred LAS also comprise an alkyl group comprising from about 9 to about 15 carbon atoms, in straight chain configuration.

Gel Breaker

The compositions of the present invention comprise a gel breaker selected from the group consisting of amino alcohol compounds having a molecular weight above 61 g/mol. More preferably the gel breaker has molecular weight above 117 g/mol. Although not wishing to be bound by theory, it is believed that the greater the molecular weight, the greater is the steric hindrance of the gel breaker and the better is the performance in breaking a gel.

More preferably the gel breaker is selected from the group consisting of triethanolamine, diisopropanolamine, triisopropanolamine, Monoamino hexanol, 2-[(2-methoxyethyl)methylamino]-ethanol, Propanolamine, N-Methylethanolamine, diethanolamine, Monobutanol amine, Isobutanolamine, Monopentanol amine, 1-Amino-3-(2-methoxyethoxy)-2-propanol, 2-Methyl-4-(methylamino)-2-butanol, 6-amino-1-hexanol, Heptaminol, Isoetarine, Norepinephrine, Sphingosine, Phenylpropanolamine and mixtures thereof.

More preferably, the gel breaker is selected from the group consisting of triethanolamine, diisopropanolamine, triisopropanolamine, Monoamino hexanol, 2-[(2-methoxyethyl)methylamino]-ethanol, Propanolamine, N-Methylethanolamine, diethanolamine, Monobutanol amine, Isobutanolamine, Monopentanol amine, 1-Amino-3-(2-methoxyethoxy)-2-propanol, 2-methyl-4-(methylamino)-2-butanol and mixtures thereof.

The most preferred gel breaker is selected from the group consisting of triethanolamine, triiso propanolamine, 6-amino-1-hexanol and mixtures thereof.

The gel breaker of the present invention is preferably present at a level of greater than 1%, more preferably greater than 1.5%, more preferably greater than 1.8%. The gel breaker is preferably present at less than 6%, more preferably less that 5%, most preferably less than 4% by weight of the composition.

Solvent

The present compositions may comprise a solvent system. A solvent system may comprise water alone or mixtures of organic solvents with water. Preferred organic solvents include 1,2-propanediol, ethanol, glycerol, dipropylene glycol, methyl propane diol, monoethanolamine and mixtures thereof.

Water according to the present invention is interpreted to mean total water present in the composition, as measured by Karl Fisher standard method ISO760-1978.

Solvent systems can be absent, for example from anhydrous embodiments of the invention, but more typically are present at levels in the range of from about 0.1% to about 98%, preferably at least about 1% to about 50%, more usually from about 5% to about 25%.

The composition of the present invention comprises both surfactant and solvent, which includes water. However it is essential that the ratio of total surfactant to total solvent in the composition be greater than 1.5:1, more preferably greater than 2:1. For avoidance of doubt, total surfactant, therefore includes the high 2-phenyl linear alkylbenzene sulphonate, essential to the present invention, and all other surfactants. Solvent, includes all solvents above, including water, but does not include the gel breakers of the present invention.

Optional Detergent Composition Components

The compositions of the present invention may comprise one or more of the ingredients as discussed below.

Surfactants or Detersive Surfactants

The compositions of the present invention preferably comprise from about 1% to 80% by weight of a further surfactant. Surfactant, in addition to the high 2 phenyl content LAS derived from the DETAL™ process is particularly preferred. Preferably said composition comprises from about 5% to 50% by weight of surfactant.

Detersive surfactants utilized can be of the anionic, nonionic, zwitterionic, ampholytic or cationic type or can comprise compatible mixtures of these types. More preferably surfactants are selected from the group consisting of anionic, nonionic, cationic surfactants and mixtures thereof. Preferably the compositions are substantially free of betaine surfactants. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. It is preferred that the composition comprises an amount of linear straight chain alkylbenzene sulfonates, prepared from the more traditional process using hydrogen fluoride. In this instance, it is preferred that the average number of carbon atoms in the alkyl group is from about 11 to 13, abbreviated as $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Fabric Care Benefit Agents

The compositions may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the composition, are suitably at levels of up to about 30% by weight of the composition, more typically from about 1% to about 20%, preferably from about 2% to about 10%.

Detersive Enzymes

Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compositions are from about 0.0001% to about 5%. When enzymes are present, they can be used at very low levels, e.g., from about 0.001% or lower, in certain embodiments of the invention; or they can be used in heavier-duty laundry detergent formulations in accordance with the invention at higher levels, e.g., about 0.1% and higher. In accordance with a preference of some consumers for "non-biological" detergents, the present invention includes both enzyme-containing and enzyme-free embodiments.

Opacifier

The composition of the present invention may optionally comprise an opacifier. An opacifier according to the present invention is a solid, inert compound which does not dissolve in the composition and refracts, scatters or absorbs most light wavelengths. Suitable opacifiers have a refractive index (RI) substantially different from the system in which it is incorporated. The opacifier is preferably selected from the group consisting of styrene/acrylate latexes, titanium dioxide, Tin dioxide, any forms of modified TiO2, for example carbon modified TiO2 or metallic doped (e.g. Platinum, Rhodium) TiO2 or stannic oxide, bismuth oxychloride or bismuth oxychloride coated TiO2/Mica, silica coated TiO2 or metal oxide coated and mixtures thereof. Particularly preferred styrene/acrylate latexes are those available from the Rohm & Haas Company sold under the trademark Acusol. The latexes are characterized by pH of about 2 to about 3, having approximately 40% solids in water, with particle size of about 0.1 to about 0.5 micron. Where present, said opacifiers are present at a level of from 0.001% to 2.5%, more preferably from 0.01% to 2.0%, most preferably from 0.05% to 1.5% by weight of the composition.

Antioxidant

The composition of the present invention may comprise an antioxidant. The antioxidant is preferably selected from the group consisting of butylated hydroxyl toluene (BHT), butylated hydroxyl anisole (BHA), trimethoxy benzoic acid (TMBA), α, β, λ and δ tocophenol (vitamin E acetate), 6 hydroxy-2,5,7,8-tetra-methylchroman-2-carboxylic acid (trolox), 1,2, benzisothiazoline-3-one (proxel GLX), tannic acid, galic acid, Tinoguard AO-6, Tinoguard TS, ascorbic acid, alkylated phenol, ethoxyquine 2,2,4 trimethyl, 1-2-dihydroquinoline, 2,6 di or tert or butyl hydroquinone, tert, butyl, hydroxyl anisole, lignosulphonic acid and salts thereof, benzofuran, benzopyran, tocopherol sorbate, butylated hydroxyl benzoic acid and salts thereof, galic acid and its alkyl esters, uric acid, salts thereof and alkyl esters, sorbic acid and salts thereof, dihydroxy fumaric acid and salts thereof, and mixtures thereof. Preferred antioxidants are those selected from the group consisting of alkali and alkali earth metal sulfites and hydrosulfites, more preferably sodium sulfite or hydrosulfite. The antioxidant is preferably present at a level of from 0.01% to 2%, more preferably from 0.1% to 1%, most preferably from 0.3% to 0.5%.

Deposition Aid

As used herein, "deposition aid" refers to any cationic polymer or combination of cationic polymers that significantly enhance the deposition of a fabric care benefit agent onto the fabric during laundering.

Preferably, the deposition aid is a cationic or amphoteric polymer. The amphoteric polymers of the present invention will also have a net cationic charge, i.e.; the total cationic charges on these polymers will exceed the total anionic charge. Nonlimiting examples of deposition enhancing agents are cationic polysaccharides, chitosan and its derivatives and cationic synthetic polymers. Preferred cationic polysaccharides include cationic cellulose derivatives, cationic guar gum derivatives, chitosan and derivatives and cationic starches.

Rheology Modifier

In a preferred embodiment of the present invention, the composition comprises a rheology modifier. The rheology modifier is selected from the group consisting of non-polymeric crystalline, hydroxy-functional materials, polymeric rheology modifiers which impart shear thinning characteristics to the aqueous liquid matrix of the composition. Crystalline, hydroxy-functional materials are rheology modifiers which form thread-like structuring systems throughout the matrix of the composition upon in situ crystallization in the matrix. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis). Polymeric rheology modifiers are preferably selected from polyacrylates, polymeric gums, other non-gum polysaccharides, and combinations of these polymeric materials. Preferred polymeric gum materials include pectine, alginate, arabinogalactan (gum Arabic), carrageenan, gellan gum, xanthan gum, guar gum and mixtures thereof.

Builder

The compositions of the present invention may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. Particularly preferred are citrate builders, e.g., citric acid and soluble salts thereof (particularly sodium salt.

Other preferred builders include ethylene diamine disuccinic acid and salts thereof (ethylene diamine disuccinates, EDDS), ethylene diamine tetraacetic acid and salts thereof (ethylene diamine tetraacetates, EDTA), and diethylene triamine penta acetic acid and salts thereof (diethylene triamine penta acetates, DTPA), aluminosilicates such as zeolite A, B or MAP; fatty acids or salts, preferably sodium salts, thereof, preferably C12-C18 saturated and/or unsaturated fatty acids; and alkali or alkali earth metal carbonates preferably sodium carbonate.

Bleaching System

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt (III) and related complexes (U.S. Pat. No. 4,810,410).

Perfume

Perfumes are preferably incorporated into the detergent compositions of the present invention. The perfumes may be prepared as a premix liquid, may be linked with a carrier material, such as cyclodextrin or may be encapsulated. When encapsulated the perfumes are preferably encapsulated in a melamine/formaldehyde coating. The applicants have found that even in the presence of such perfume microcapsules, the present system is able to maintain the whiteness and prevent or reduce discolouration of the composition. This is further surprising as the aldehyde aspect of perfumes and the formaldehyde coating further heighten the risk of discolouration (yellowing) of the composition.

Whitening Agent

A composition of the present invention may comprise a whitening agent. The whitening agent is included in the total laundry detergent composition in an amount sufficient to provide a tinting effect to fabric washed in a solution containing the detergent. In one embodiment, the composition comprises by weight, from about 0.0001% to about 1%, more preferably from about 0.0001% to about 0.5% by weight of the composition, and even more preferably from about 0.0001% to about 0.3% by weight of the composition.

Examples of preferred commercially available whitening agents according to the present invention are selected from the list consisting of triarylmethane blue basic dye; a triarylmethane violet basic dye; a methine blue basic dye; a methane violet basic dye; an anthraquinone blue basic dye; an antraquinone violet basic dye; an azo dye basic blue 16, basic blue 65, basic blue 66, basic blue 67, basic blue 71, basic blue 159, basic violet 19, basic violet 35, basic violet 38, or basic violet 48; oxazine dye basic blue 3, basic blue 75, basic blue 95, basic blue 122, basic blue 124, basic blue 141, or Nile blue A; a xanthene dye basic violet 10; an alkoxylated anthraquinone polymeric colorant; alkoxylated thiophene; triphenyl methane; antraquinones; or a mixture thereof.

Most Preferably the whitening agent is characterized by the following structure:

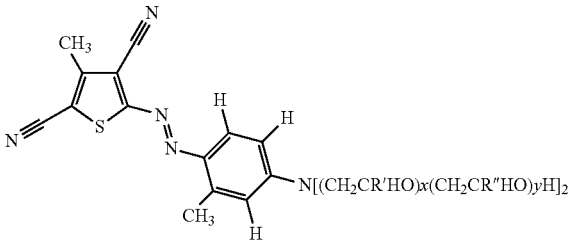

wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_zH$, and mixtures thereof; wherein $x+y \leqq 5$; wherein $y \geqq 1$; and wherein $z=0$ to 5

Pearlescent Agent

The compositions of the present invention may comprise a pearlescent agent. Said pearlescent agent may be organic or inorganic, but is preferably inorganic. Most preferably the pearlescent agent is selected from mica, TiO2 coated mica, bismuth oxychloride or mixtures thereof.

Other Adjuncts

Examples of other suitable cleaning adjunct materials include, but are not limited to; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents and mixtures thereof.

Composition Preparation

The compositions herein can generally be prepared by mixing the ingredients together. If a pearlescent material is used it should be added in the late stages of mixing. If a rheology modifier is used, it is preferred to first form a premix within which the rheology modifier is dispersed in a portion of the water and ad this pre-mix to the remaining ingredients.

Process of Washing

The pouches of the present invention are suitable for laundry cleaning applications. The pouches are suitable for hand or machine washing conditions. When machine washing, the pouch may be delivered from the dispensing drawer or may be added directly into the washing machine drum.

Examples

The data below provides evidence of the benefits of the present invention:

Compositions B and C are examples of the present invention. Compositions A, D and E are comparative compositions which do not show the effect of the present invention.

| Ingredients | A | B | C | D | E |
|---|---|---|---|---|---|
| Alkylbenzene sulfonic acid C 11-13, 23.5% 2-phenyl isomer | 14.5 | 14.5 | 14.5 | 14.5 | 14.5 |
| $C_{12-14}$ alkyl ethoxy 3 sulfate | 7.5 | 7.5 | 7.5 | 7.5 | 7.5 |
| $C_{12-14}$ alkyl 7-ethoxylate | 13.0 | 13.0 | 13.0 | 13.0 | 13.0 |
| Citric Acid | 0.6 | 0.6 | 0.6 | 0.6 | 0.6 |
| Fatty Acid | 14.8 | 14.8 | 14.8 | 14.8 | 14.8 |
| Enzymes | 1.7 | 1.7 | 1.7 | 1.7 | 1.7 |
| Ethoxylated Polyethylenimine[1] | 4.0 | 4.0 | 4.0 | 4.0 | 4.0 |
| Hydroxyethane diphosphonic acid | 1.2 | 1.2 | 1.2 | 1.2 | 1.2 |
| Brightener | 0.3 | 0.3 | 0.3 | 0.3 | 0.3 |
| P-diol | 15.8 | 13.8 | 13.8 | 13.8 | 13.8 |
| Glycerol | 6.1 | 6.1 | 6.1 | 6.1 | 6.1 |
| MEA | 8.0 | 8.0 | 8.0 | 8.0 | 8.0 |
| TIPA | — | — | 2.0 | — | — |
| TEA | — | 2.0 | — | — | — |
| Cumene sulphonate | — | — | — | — | 2.0 |
| cyclohexyl dimethanol | — | — | — | 2.0 | — |
| Water | 10 | 10 | 10 | 10 | 10 |
| Structurant | 0.14 | 0.14 | 0.14 | 0.14 | 0.14 |
| Perfume | 1.9 | 1.9 | 1.9 | 1.9 | 1.9 |
| Buffers (monoethanolamine) | | | To pH 8.0 | | |
| Solvents (1,2 propanediol, ethanol) | | | To 100p | | |
| Visual grading: Finished Product Stability at 4° C. | | | | | |
| 1 week | Frozen | Clear, isotropic | Clear, isotropic | Frozen | Frozen |
| 3 weeks | Frozen | 1 single crystal forming (not visible) | Clear, isotropic | Frozen | Frozen |
| 6 weeks | Frozen | Some crystals (visible) | Clear, isotropic | Frozen | Frozen |

Examples F is a comparative example, and can be directly compared with composition G, which is within the scope of the present invention.

| Ingredients | F | G |
|---|---|---|
| HLAS C11-13 and 30% 2-phenyl | 15.0 | 15.0 |
| $C_{12-14}$ alkyl ethoxy 3 sulfate | 8.0 | 8.0 |
| $C_{12-14}$ alkyl 7-ethoxylate | 13.6 | 13.6 |
| Citric Acid | 0.6 | 0.6 |
| Fatty Acid | 16.7 | 16.7 |
| Enzymes | 1.8 | 1.8 |
| Ethoxylated Polyethylenimine[1] | 4.3 | 4.3 |
| Hydroxyethane diphosphonic acid | 1.3 | 1.3 |
| Brightener | 0.3 | 0.3 |
| Glycerol | 6.5 | 6.5 |
| TIPA | — | 2 |
| Water and minors | 10 | 10 |
| Buffers (monoethanolamine) | | |
| Solvents (1,2 propanediol, ethanol) | | |
| 1 week | Frozen | Clear, isotropic |
| 3 weeks | Frozen | Clear isotropic |

[1]Polyethylenimine (MW = 600) with 20 ethoxylate groups per —NH.
[2]Ethoxylated thiophene, EO ($R_1 + R_2$) = 5

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cite in the Detailed Description of the Invention are, in relevant part, incorporated herein by reference, the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent comprising less than about 40% total water or non-amino functional solvent, alkyl benzene sulphonate surfactant comprising greater than about 20% of a 2 phenyl isomer and a gel breaker selected from the group consisting of triiso pronanolamine, 6-amino-1-hexanol and mixtures thereof, wherein the composition has a ratio of total surfactant to total solvent of greater than about 2:1 and further wherein the gel breaker is present in said liquid detergent composition at a level of greater than about 1% and less than about 4%.

2. The liquid detergent composition according to claim 1, the alkyl benzene sulphonate surfactant comprising greater than about 24% of the 2 phenyl isomer.

3. The liquid detergent composition according to claim 1, the alkyl benzene sulphonate surfactant comprising greater than about 30% of the 2 phenyl isomer.

4. The liquid detergent composition according to claim 1, wherein the composition is translucent.

* * * * *